US008078084B2

(12) United States Patent
Kamei et al.

(10) Patent No.: US 8,078,084 B2
(45) Date of Patent: Dec. 13, 2011

(54) IMAGE FORMING APPARATUS INCLUDING A PHOTORECEPTOR AND A SUPPLYING MEMBER ARRANGED TO SUPPLY THE PHOTORECEPTOR WITH TONER

(75) Inventors: Takaaki Kamei, Kyoto (JP); Naritoshi Takamatsu, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 414 days.

(21) Appl. No.: 12/408,774

(22) Filed: Mar. 23, 2009

(65) Prior Publication Data

US 2009/0285600 A1 Nov. 19, 2009

(30) Foreign Application Priority Data

May 15, 2008 (JP) ..... 2008-128524

(51) Int. Cl.
*G03G 21/18* (2006.01)

(52) U.S. Cl. ..... 399/113; 399/117

(58) Field of Classification Search ..... 399/107, 399/110–114, 119
See application file for complete search history.

(56) References Cited

U.S. PATENT DOCUMENTS

| | | | | |
|---|---|---|---|---|
| 5,583,618 | A | 12/1996 | Takeuchi et al. | |
| 6,603,939 | B1 * | 8/2003 | Toba et al. | 399/103 |
| 6,731,893 | B2 * | 5/2004 | Okoshi | 399/119 |
| 2001/0026707 | A1 | 10/2001 | Miyabe et al. | |

FOREIGN PATENT DOCUMENTS

| | | | |
|---|---|---|---|
| JP | 04-24656 | A | 1/1992 |
| JP | 05-158351 | A | 6/1993 |
| JP | 07-325530 | A | 12/1995 |
| JP | 09-096937 | A | 4/1997 |
| JP | 2001-201999 | A | 7/2001 |
| JP | 2001-281995 | A | 10/2001 |
| JP | 2005-338391 | A | 12/2005 |
| JP | 2006-251463 | A | 9/2006 |
| JP | 2007-322565 | A | 12/2007 |

OTHER PUBLICATIONS

Official Communication issued in corresponding Japanese Patent Application No. 2008-128524, mailed on Apr. 12, 2010.

* cited by examiner

*Primary Examiner* — Hoan Tran
(74) *Attorney, Agent, or Firm* — Keating & Bennett, LLP

(57) ABSTRACT

An image forming apparatus in which a drum unit or a developing unit can be individually replaced, and the efficiency of an operation of providing the developing unit with developer or of an operation of removing the developer from the developing unit can be improved includes a supplying roller including a magnetic roller and a developing sleeve arranged on an outer circumference of the magnetic roller. A fixing member is attached to an axial portion of the magnetic roller. The supplying roller can be removably attached to a side of a photoconductive drum by the fixing member, and at the same time, a pole position of the magnetic roller relative to the photoconductive drum can be fixed.

9 Claims, 4 Drawing Sheets

IMAGE FORMING APPARATUS INCLUDING A PHOTORECEPTOR AND A SUPPLYING MEMBER ARRANGED TO SUPPLY THE PHOTORECEPTOR WITH TONER

CROSS-REFERENCE TO RELATED APPLICATIONS

This application claims priority under 35 U.S.C. 119 to Japanese Patent Application No. 2008-128524, filed on May 15, 2008, which application is hereby incorporated by reference in its entirety.

BACKGROUND OF THE INVENTION

1. Field of the Invention

The present invention relates to an image forming apparatus including a photoreceptor and a supplying member arranged to supply the photoreceptor with toner.

2. Description of the Related Art

In a conventional image forming apparatus, such as a copier, a facsimile machine, and a printer, for example, an apparatus using an electro photographic system includes a photoconductive drum on which an electrostatic latent image is formed through laser light and a developing unit arranged to supply the photoconductive drum with toner. As a developing method of the developing unit, a one-component developing method using magnetic toner as developer and a two-component developing method using nonmagnetic toner and magnetic particles (carrier) as developer are used.

The developing unit using the two-component developing method includes a cylindrical magnetic roller and a developing sleeve arranged on an outer circumferential surface of the magnetic roller, both of which serve as a supplying unit that supplies the photoconductive drum with toner. The magnetic roller functions as a carrier adsorbing member, and in this case, because toner is adhered to the carrier, the magnetic roller functions as a toner-and-carrier-adsorbing member. The developing sleeve functions as a member that separates the toner from the two-component developer (mixture of toner and carrier) and attracts the toner to the photoconductive drum. By applying a bias voltage to the developing sleeve, a magnetic field is generated between the developing sleeve and the photoconductive drum, and ears composed of developer are formed on a surface of the developing sleeve. The ears composed of the developer connect with one another along magnetic lines of the generated magnetic field as if the ears are rice ears. Since the density of the magnetic lines is increased in the vicinity of the magnetic roller, the ears are formed in a densely raised state. Only the toner of the ears formed on the developing sleeve is supplied to the photoconductive drum.

In the two-component developing method, an image may greatly change depending on how ears composed of the developer contact with the photoconductive drum (i.e., depending on an angle of the ears relative to the photoconductive drum). Therefore, in the conventional image forming apparatus, in order to maintain a constant position (angle) of ears that contact with the photoconductive drum, a positional relationship between the photoconductive drum and the magnetic roller is fixed by integrating a drum unit and a developing unit into one unit.

However, since the drum unit and the developing unit are integrated into one unit in the conventional art, both units cannot be separated. Therefore, it is difficult to replace only the photoconductive drum, and the drum unit and the developing unit have to be replaced together, which thereby increases the cost.

Since the drum unit and the developing unit are integrated into one unit, when supplying the developing unit with the developer or when removing the developer from the developing unit, operating efficiency decreases.

SUMMARY OF THE INVENTION

In order to overcome the problems described above, preferred embodiments of the present invention provide an image forming apparatus in which a drum unit and a developing unit can be individually replaced, and in which the efficiency of an operation of supplying the developing unit with developer or of an operation of removing the developer from the developing unit can be improved.

According to a preferred embodiment of the present invention, the image forming apparatus includes a photoreceptor and a supplying member arranged to supply the photoreceptor with the developer. The supplying member includes a magnetic roller and a developing sleeve arranged on an outer circumference of the magnetic roller. A fixing member is arranged at an axial portion of the magnetic roller. The supplying member is removably attached to a side of the photoreceptor through the fixing member, and at the same time, a pole position of the magnetic roller relative to the photoreceptor can be fixed.

In the above image forming apparatus, since the supplying member is removably attached to the side of the photoreceptor through the fixing member arranged at the axial portion of the magnetic roller, when supplying the supplying member with the developer, or when doing maintenance on the photoreceptor or the supplying member, the photoreceptor or the supplying member can be easily removed from the other. Thus, the efficiency of an operation of supplying the supplying member with the developer can be improved. Further, only one of the photoreceptor and the supplying member can be replaced. Furthermore, since the supplying member is attached to the side of the photoreceptor at the same time as the pole position of the magnetic roller relative to the photoreceptor is fixed, the pole position can be automatically fixed only by attaching the supplying member to the side of the photoreceptor through the fixing member. Accordingly, an operation of setting the pole position of the magnetic roller can be omitted before/after the supplying member is attached to the side of the photoreceptor.

In the image forming apparatus according to another preferred embodiment of the present invention, the fixing member includes a protruding portion. The supplying member can be attached to the side of the photoreceptor by inserting the protruding portion into a concave portion formed on the side of the photoreceptor.

According to the above image forming apparatus, the supplying member can be easily attached to the side of the photoreceptor by inserting the protruding portion of the fixing member into the concave portion arranged on the side of the photoreceptor.

In the image forming apparatus according to another preferred embodiment of the present invention, the fixing member includes a concave portion. The supplying member can be attached to the side of the photoreceptor by inserting a protruding portion arranged on the side of the photoreceptor into the concave portion.

According to the above image forming apparatus, the supplying member can be easily attached to the side of the photoreceptor by inserting the protruding portion formed on the side of the photoreceptor into the concave portion.

According to a preferred embodiment of the present invention, the drum unit or the developing unit can be individually replaced, and moreover, the efficiency of an operation of supplying the developing unit with the developer or of an operation of removing the developer from the developing unit can be improved.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

An image forming apparatus according to preferred embodiments of the present invention will be described with reference to the drawings.

Figure 1:
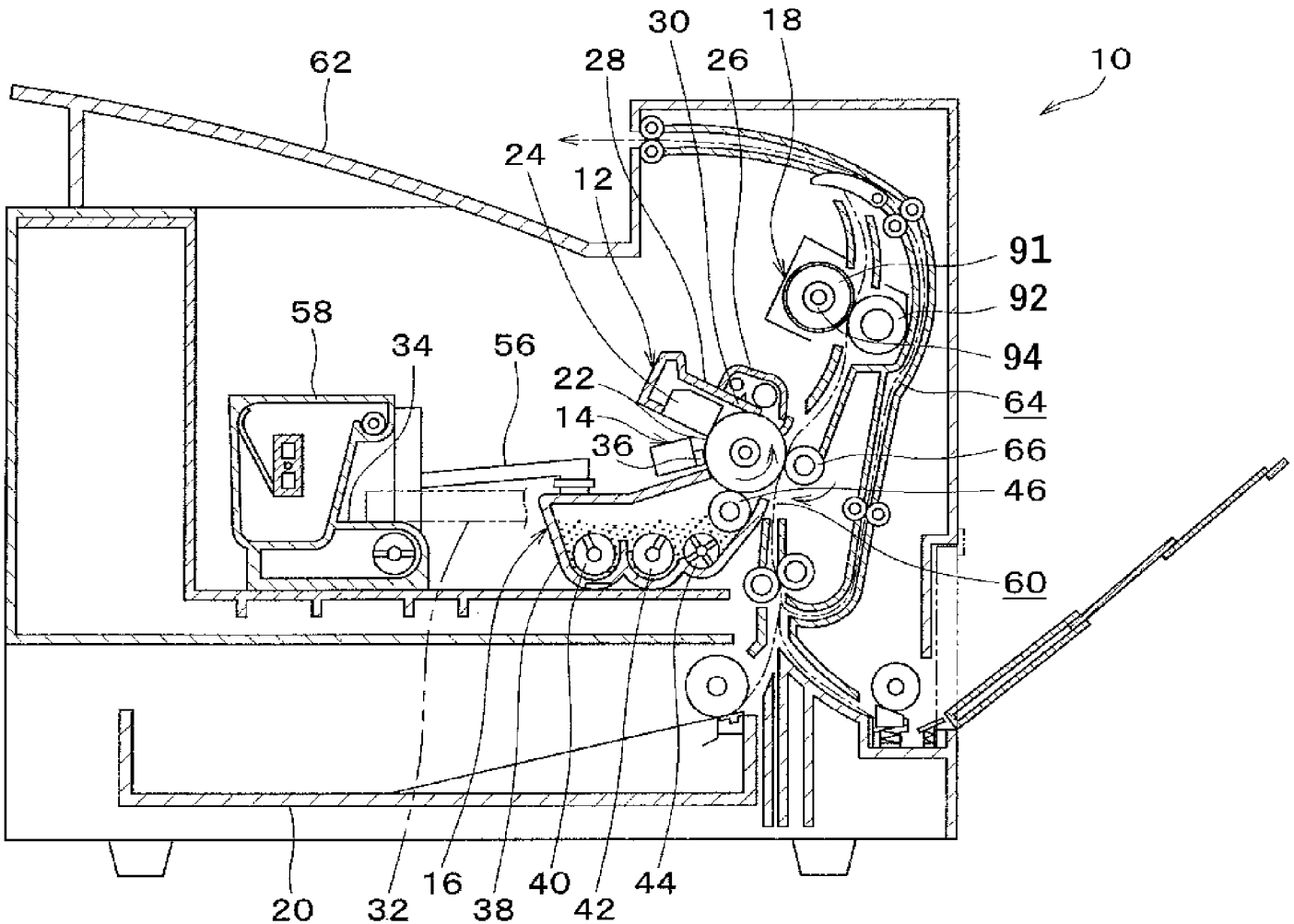
FIG. 1 is a front sectional view of an image forming apparatus according to a preferred embodiment of the present invention.

A configuration of the image forming apparatus will be described with reference to FIG. 1. FIG. 1 is a front sectional view illustrating an example of the configuration of the image forming apparatus according to a preferred embodiment of the present invention. The image forming apparatus may be a scanner, a printer, a copier, a facsimile machine, or a Multi Function Peripheral (MFP) including functions of a scanner, a printer, a copier, and a facsimile machine, for example.

As illustrated in FIG. 1, an image forming apparatus 10 primarily includes an image forming unit 12, an exposure unit 14, a developing unit 16, and a fixing unit 18, and each of the units is arranged above a paper feed cassette 20.

A general image forming process performed through the image forming apparatus 10 will be described. When a paper is fed from the paper feed cassette 20, a toner image formed on a photoconductive drum 22 of the image forming unit 12 is transferred onto the paper. Then, the transferred toner image is fixed onto the paper by the fixing unit 18. The paper on which the fixing process has been performed is discharged onto a discharge tray 62 through a main transportation path 60.

When a duplex printing process is executed in the image forming apparatus 10, a paper whose one side has been printed is supplied again to the image forming unit 12 via an inversion path 64. Then, an image forming process is executed on the other side of the paper in the image forming unit 12.

The image forming unit 12 is arranged to form a toner image and transfer the toner image onto the paper fed from the paper feed cassette 20. The image forming unit 12 primarily includes the photoconductive drum 22 used as a photoreceptor, a charging unit 24 arranged to impart a negative charge to an outer circumferential surface of the photoconductive drum 22, and a cleaning unit 26.

The photoconductive drum 22 includes a photoconductive layer around the outer circumferential surface thereof and is used as an electro photographic photoreceptor. The photoconductive drum 22 is disposed in the vicinity of a lower portion of the image forming unit 12. The photoconductive drum 22 is contained in a frame 28 such that a lower side of the photoconductive drum 22 is exposed to the outside. Therefore, the portion of the photoconductive drum 22 is exposed from the frame 28 to make contact with a supplying roller (a supplying member) 46 of the developing unit 16 and with a transfer roller 66, making it possible to execute a toner supplying process and a toner transferring process.

The cleaning unit 26 is contained in the frame 28 and collects the residual toner, which has not been transferred, from the photoconductive drum 22 by using a cleaning blade 30. The collected residual toner is accumulated in a residual toner tank 34 by a transportation mechanism 32. Accordingly, the image forming unit 12 can execute a preferable image forming process without being affected by the residual toner.

The charging unit 24 is disposed along a longitudinal direction (a front and back direction) of the photoconductive drum 22 and includes a saw-shaped electrode (not illustrated) arranged to impart a negative charge to the photoconductive drum 22. Accordingly, when a high voltage is applied to the saw-shaped electrode to generate a corona discharge, the negative charge is imparted to the outer circumferential surface of the photoconductive drum 22.

The exposure unit 14 includes a plurality of substantially linearly aligned light emitting portions (for example, Light Emission Diodes or LEDs) 36. The exposure unit 14 is disposed obliquely below the photoconductive drum 22. The photoconductive drum 22 is irradiated with light emitted from the light emitting portions 36.

Accordingly, when lighting control (an exposing process) is performed for each of the light emitting portions 36 based on image data to be printed on a paper, the negative charge is removed from the portion on the outer circumferential surface of the photoconductive drum 22, which portion was irradiated with the light emitted from the light emitting portions 36. In other words, an electrostatic latent image that corresponds to the image data is formed on the outer circumferential surface of the photoconductive drum 22.

The developing unit 16 includes a developing device 38 arranged to contain two-component developer composed of toner and carrier, two screw members 40 and 42, a paddle 44, and the supplying roller 46 and supplies the outer circumferential surface of the photoconductive drum 22 with nonmagnetic toner. That is, the toner and the carrier are properly mixed by the two screw members 40 and 42 to impart the negative charge to the unused nonmagnetic toner, and the negatively-charged toner is scraped out by the paddle 44 and supplied to a side of the supplying roller 46. Further, the toner is supplied to a surface of the photoconductive drum 22 from the supplying roller 46.

The first screw member 40 used to transport the developer in a prescribed direction (i.e., a paper-width direction of FIG. 1) while agitating the developer is rotatably provided inside the developing device 38. The first screw member 40 is rotationally driven by a motor that is drive-controlled by a printer controller (i.e., a not-illustrated control unit) to transport the developer in the prescribed direction while agitating the developer. Thus, the developer (the toner and the carrier) is transported by the first screw member 40 while being agitated. While being transported, the toner and the carrier are properly mixed, and the toner is negatively charged.

The second screw member 42 used to transport the developer in a prescribed direction while agitating the developer is rotatably provided inside the developing device 38. The second screw member 42 is arranged parallel or substantially parallel to the first screw member 40. The second screw member 42 is rotationally driven by the motor that is drive-controlled by the printer controller to transport the developer in the prescribed direction while agitating the developer. Thus, the developer (the toner and the carrier) is transported by the second screw member 42 while being agitated. While being transported, the toner and the carrier are properly mixed, and the toner is negatively charged.

More specifically, while being agitated, the developer is transported from an edge portion on one side of an axial direction of the first screw member 40 towards the other edge portion on the other side of the axial direction. After reaching the other edge portion on the other side of the axial direction of the first screw member 40, the developer moves towards an edge portion on one side of an axial direction of the second screw member 42. Then, while being agitated, the developer moves from the one edge portion on the one side of the axial direction of the second screw member 42 to the other edge portion on the other side of the axial direction. A substantial portion of the toner of the developer transported by the second screw member 42 is supplied to a side of the supplying roller 46 by the paddle 44. After reaching the other edge portion on the other side of the axial direction of the second screw member 42, the carrier and residual toner of the developer transported by the second screw member 42 move to the one edge portion on the one side of the axial direction of the first screw member 40. Similarly, while being agitated, the toner (the developer) is transported by the first screw member 40 thereafter.

The supplying roller 46 supplies the photoconductive drum 22 having an electrostatic latent image formed thereon with the toner (negatively charged toner) supplied by the paddle 44. Thus, the toner supplied from the supplying roller 46 to the photoconductive drum 22 is adhered to the portion of the outer circumferential surface from which the negative charge has been removed.

Figure 2:
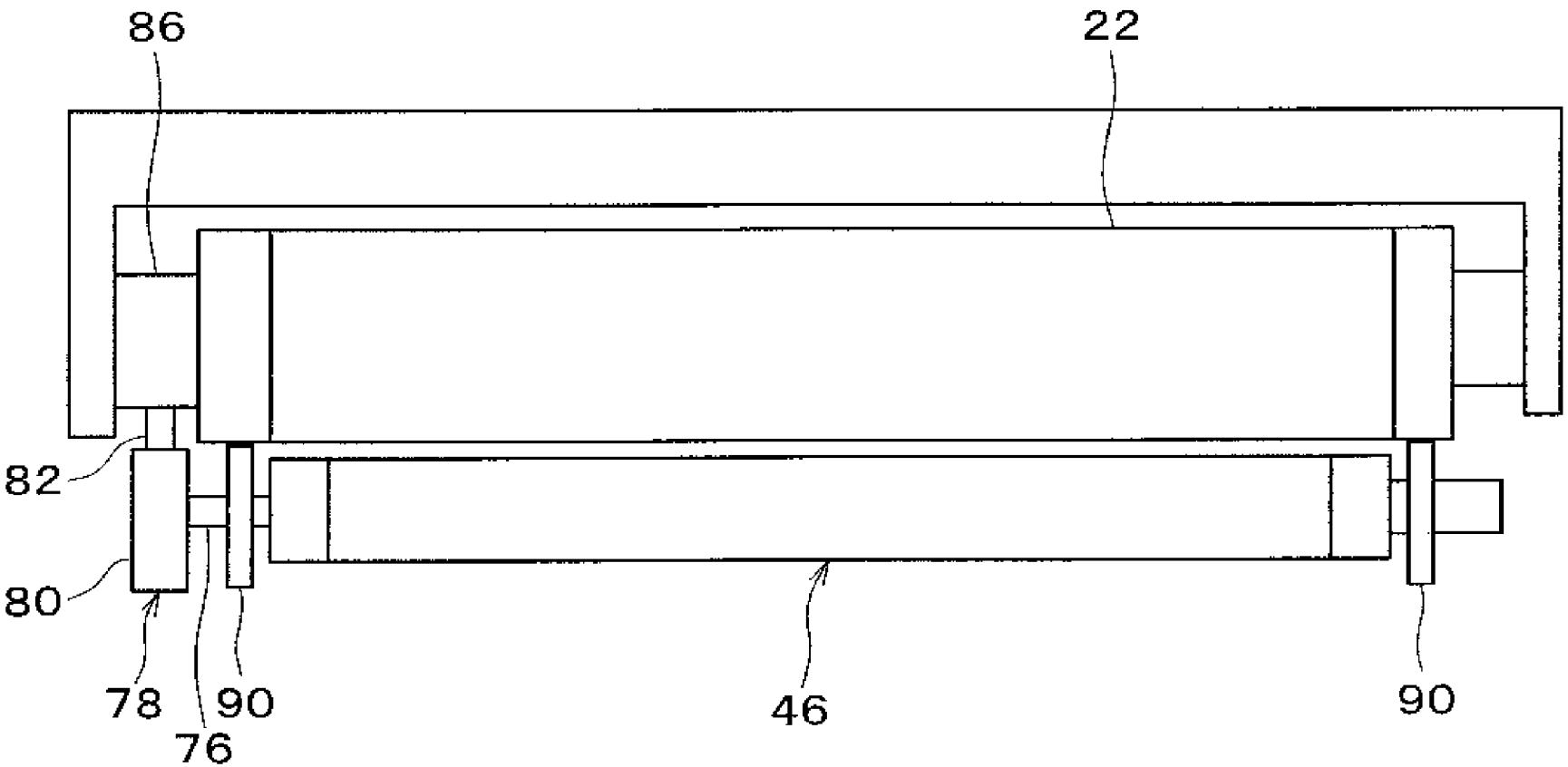
FIG. 2 illustrates a configuration of a photoconductive drum and a supplying roller of the image forming apparatus according to a preferred embodiment of the present invention.
Figure 3:
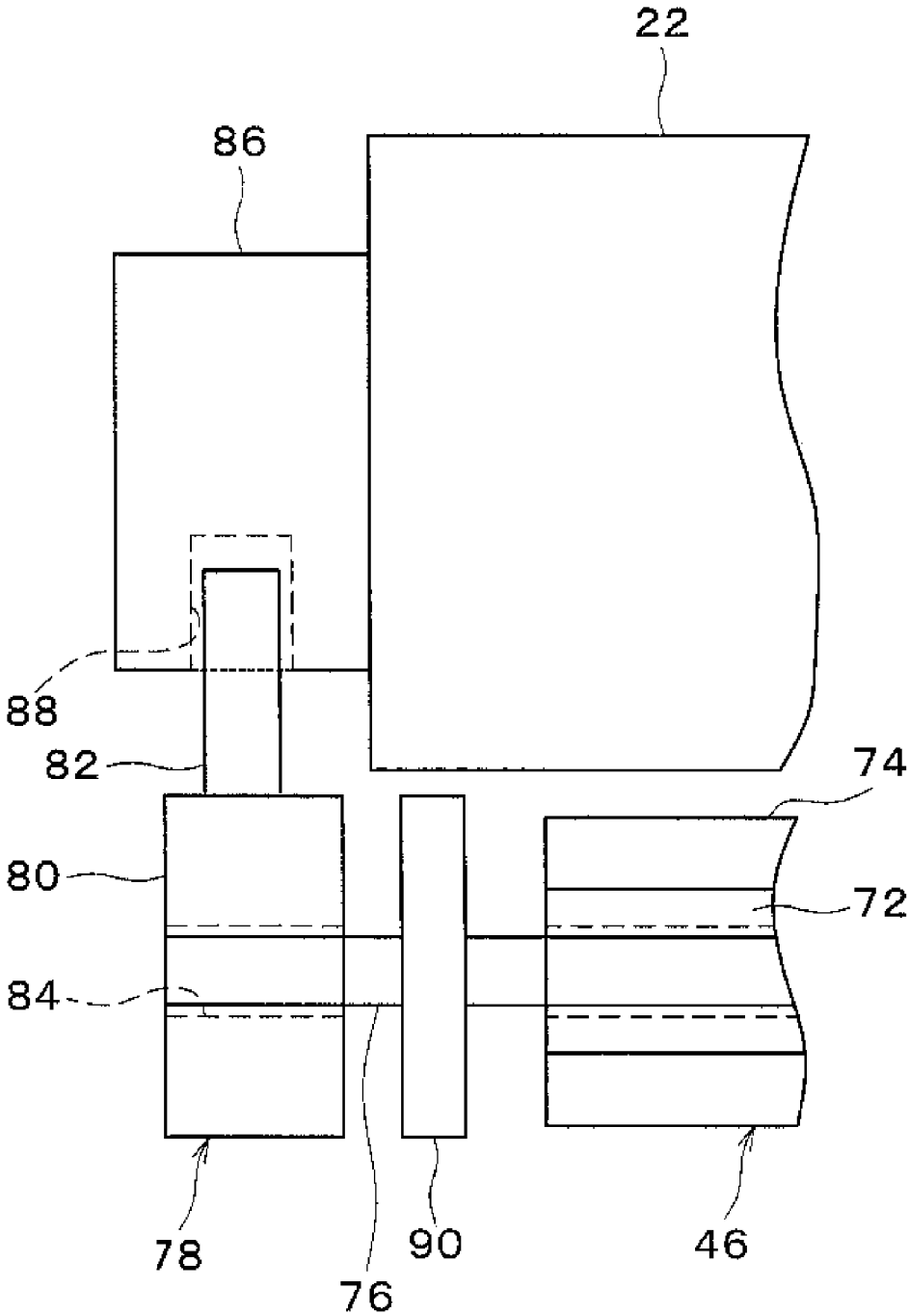
FIG. 3 is an enlarged view illustrating a fixing member arranged to fix the photoconductive drum and the supplying roller of the image forming apparatus according to a preferred embodiment of the present invention.
Figure 4:
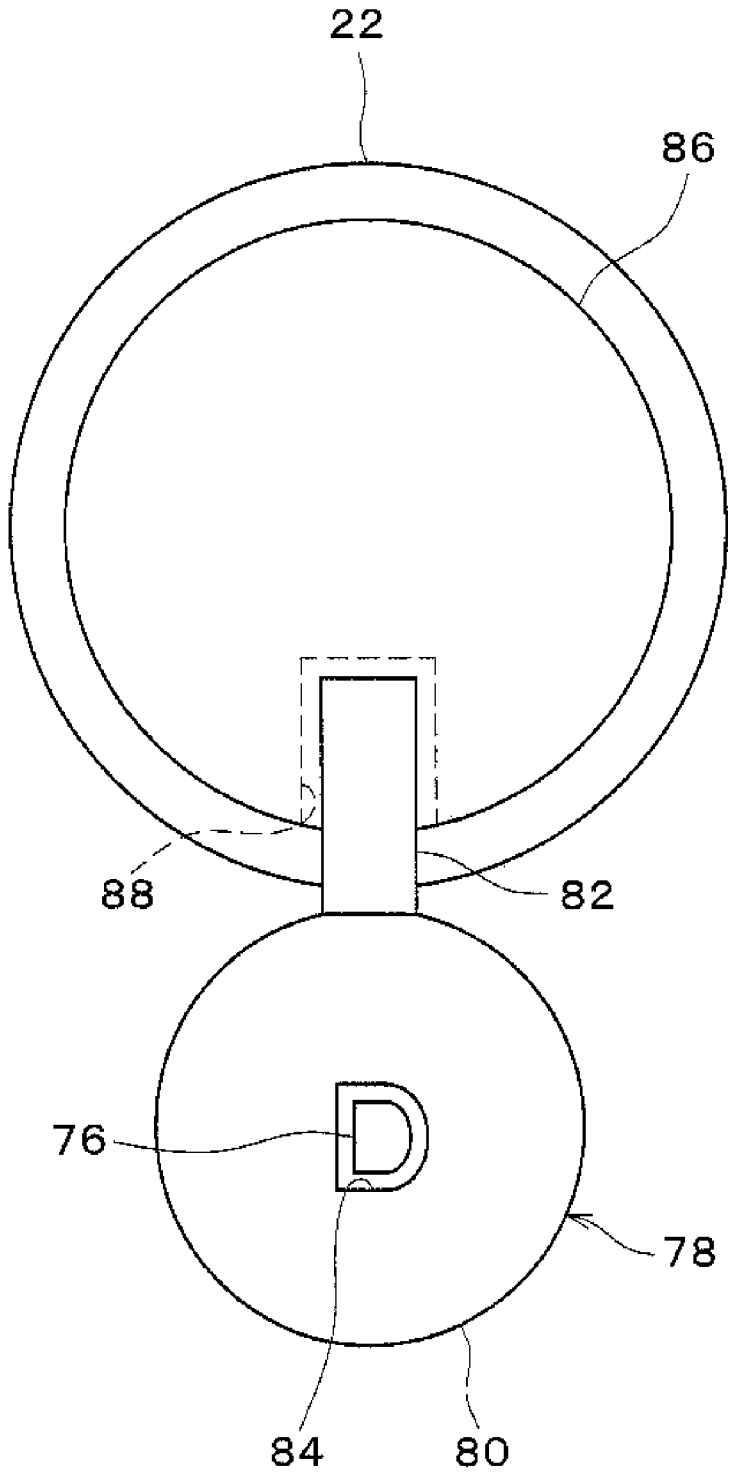
FIG. 4 is a side view of FIG. 3.

As illustrated in FIGS. 2 through 4, the supplying roller 46 includes a cylindrical magnetic roller 72, a developing sleeve 74 surrounding the magnetic roller 72, and a shaft 76 fixed to the magnetic roller 72. In the developing device 38 using the two-component developer, the developing sleeve 74 is disposed apart from the photoconductive drum 22 and opposes the photoconductive drum 22 in a non-contact state. Thus, the carrier can be prevented from being adhered to the photoconductive drum 22, and the life of the apparatus can be prolonged.

The magnetic roller 72 includes north (N) poles and south (S) poles alternately arranged at substantially even intervals in a circumferential direction. A magnetic field is generated on each and every portion in the circumferential direction on an outer side of the magnetic roller 72. The magnetic fields generated by the magnetic roller 72 extend to an outer side of the developing sleeve 74. The carrier is adhered by the magnetic fields to a surface of the developing sleeve 74. Thus, because of the magnetic fields of the magnetic roller 72, the two-component developer (the toner and the carrier) forms into ears and adheres to the developing sleeve 74. Then, only the toner (negatively charged toner) of the ears of the two-component developer adhered to the developing sleeve 74 is affected by the actions of the magnetic fields, flown and supplied to the photoconductive drum 22.

The magnetic roller 72 and the shaft 76 are fixed and do not rotate. On the other hand, the developing sleeve 74 is connected with a rotation driving member (not illustrated) and axially rotated. Accordingly, the developing sleeve 74 is relatively rotated with respect to the magnetic roller 72.

An edge portion on one side of an axial direction of the shaft 76 is preferably shaped like a capital "D" in a sectional view. A substantially cylindrical fixing member 78 is attached to the edge portion on the one side of the axial direction of the shaft 76. The fixing member 78 includes a cylindrical fixing member body 80 and a protruding portion (for example, a pin or a rib) 82 protruding from an outer circumferential surface of the fixing member body 80. A preferably D-shaped through-hole 84 is provided at the center of a cross-section of the fixing member body 80. The edge portion on the one side of the axial direction of the shaft 76 is inserted into the through-hole 84 of the fixing member body 80.

The protruding portion 82 of the fixing member 78 is pushed (inserted) into a concave portion (for example, a chase) 88 defined in a shaft 86 of the photoconductive drum 22. Since the shaft 86 of the photoconductive drum 22 is fixed, only the photoconductive drum 22 is rotated, and the shaft 86 is not rotated.

By pushing the protruding portion 82 of the fixing member 78 into the concave portion 88, the supplying roller 46 is attached to a side of the photoconductive drum 22, and a pole position of the magnetic roller 72 relative to the photoconductive drum 22 is fixed. In other words, the fixing member 78 includes a function of removably attaching the supplying roller 46 to the side of the photoconductive drum 22 and a function of fixing the pole position of the magnetic roller 72 of the supplying roller 46 relative to the photoconductive drum 22. The supplying roller 46 is attached to the side of the photoconductive drum 22 with the fixing member 78, and at the same time, the pole position of the magnetic roller 72 relative to the photoconductive drum 22 is properly fixed. Thus, by only attaching the supplying roller 46 to the side of the photoconductive drum 22 with the fixing member 78, the proper pole position of the magnetic roller 72 relative to the photoconductive drum 22 is automatically fixed. Accordingly, an operation of adjusting the pole position of the magnetic roller 72 relative to the photoconductive drum 22 becomes unnecessary. Thus, because the proper pole position of the magnetic roller 72 relative to the photoconductive drum 22 can be automatically fixed by only attaching the supplying roller 46 to the side of the photoconductive drum 22 with the fixing member 78, a positional relationship between the photoconductive drum 22 and the ears of the developer generated on the developing sleeve 74 can be maintained in a suitable state.

The diameter of the fixing member body 80 is preferably greater than the diameter of the supplying roller 46 (the developing sleeve 74). The length of the protruding portion 82 protruding from the fixing member body 80 is set such that a portion of the protruding portion 82 is positioned outside of the outer circumferential surface of the photoconductive drum 22 (i.e., positioned on a side of the fixing member body 80) when the protruding portion 82 is pushed into the concave portion 88. Therefore, by adjusting the sum of the length in a radius direction of the fixing member body 80 and the protruding length of the protruding portion 82, a proper distance between the photoconductive drum 22 and the supplying roller 46 can be maintained constant. As described above, the fixing member 78 can function as a gap pulley.

A gap pulley 90 is attached to the shaft 76 of the magnetic roller 72 in order to maintain a constant distance between the photoconductive drum 22 and the supplying roller 46. The distance between the photoconductive drum 22 and the supplying roller 46 can be maintained constant also by the gap pulley 90.

Alternatively, by attaching the fixing members 78 to both the edge portion on the one side of the axial direction of the shaft 76 of the magnetic roller 72 and the other edge portion on the other side of the axial direction of the shaft 76 such that both sides of the axial direction of the supplying roller 46 are attached to the side of the photoconductive drum 22, the gap pulley can be omitted. Thus, the number of components can be reduced.

Further, by providing the fixing member 78 with a concave portion, and by providing the shaft 86 of the photoconductive drum 22 with a protruding portion, the protruding portion may be pushed (inserted) into the concave portion.

In the developing device 38, a toner supplying port (not illustrated) is arranged at the edge portion on the one side of the axial direction of the first screw member 40. As illustrated in FIG. 1, a toner supplying path 56 is connected with the toner supplying port. An edge portion on one side of the toner supplying path 56 is connected with a toner tank 58, and the other edge portion on the other side is connected with the toner supplying port. The toner tank 58 is provided with a toner supplying mechanism (not illustrated) arranged therein to supply the toner supplying path with the toner in the toner tank 58. Accordingly, when the toner supplying mechanism is drive-controlled by the printer controller, the toner of the toner tank 58 is transported to the toner supplying path 56, and supplied from the toner supplying port to the inside of the developing device 38 via the toner supplying path 56.

The transfer roller 66 is arranged on the opposite side of the photoconductive drum 22 across the main transportation path 60. A bias voltage is applied to the transfer roller 66, and thus the transfer roller 66 is positively charged. Therefore, when the paper passes between the photoconductive drum 22 and the transfer roller 66, the negatively charged toner on the outer circumferential surface of the photoconductive drum 22 is made to move towards a side of the transfer roller 66. Accordingly, a toner image on the photoconductive drum 22 is transferred to the paper. The paper having the toner image transferred thereon is transported to the fixing unit 18.

The fixing unit 18 includes a heat roller 91 and a press roller 92. The heat roller 91 is preferably made of metal having high thermal conductivity (for example, aluminum), and includes a heater 94 having a halogen lamp therein. The press roller 92 is arranged on the opposite side of the heat roller 91 across the main transportation path 60. Thus, when the paper is transported to a nip portion of the heat roller 91 and the press roller 92, the paper is heated and pressed. Thus, the transferred toner image is heat-pressed and fixed on the paper.

The actions of the image forming apparatus 10 according to the present preferred embodiment will be described.

As illustrated in FIGS. 2 through 4, when attaching the supplying roller 46 to the side of the photoconductive drum 22, the supplying roller 46 can be easily attached to the side of the photoconductive drum 22 by pushing the protruding portion 82 of the fixing member 78 into the concave portion 88 arranged on the side of the photoconductive drum 22. At this time, as described in the conventional art, a problem occurs in a positional relationship between the pole position of the magnetic roller 72 and the photoconductive drum 22, however, by only pushing the protruding portion 82 of the fixing member 78 into the concave portion 88 arranged on the side of the photoconductive drum 22, the proper pole position of the magnetic roller 72 relative to the photoconductive drum 22 can be fixed. Further, since the magnetic roller 72 is always fixed to the fixing member 78 (i.e., since the magnetic roller 72 does not rotate), regardless of how many times the supplying roller 46 is attached to the side of the photoconductive drum 22 by the fixing member 78, the pole position of the magnetic roller 72 relative to the photoconductive drum 22 can be maintained constant. Thus, a relative position (a relative angle) of the ears of the developer that makes contact with the photoconductive drum 22 can be maintained constant, which thereby prevents the adverse effects on the images.

Furthermore, because the supplying roller 46 is attached to the side of the photoconductive drum 22 by pushing the protruding portion 82 of the fixing member 78 into the concave portion 88 arranged on the side of the photoconductive drum 22, the supplying roller 46 can be easily removed from the side of the photoconductive drum 22 by pulling out the protruding portion 82 of the fixing member 78 from the concave portion 88 arranged on the side of the photoconductive drum 22, if necessary. Then, when reattaching the supplying roller 46 to the side of the photoconductive drum 22, by pushing the protruding portion 82 of the fixing member 78 into the concave portion 88 arranged on the side of the photoconductive drum 22, the supplying roller 46 can be easily attached to the side of the photoconductive drum 22, and the pole position of the magnetic roller 72 relative to the photoconductive drum 22 can be maintained constant.

As a result, the photoconductive drum 22 or the supplying roller 46 can be individually replaced, and the efficiency of the operation of supplying the supply roller 46 with the developer or of the operation of removing the developer can be improved.

While the present invention has been described with respect to preferred embodiments thereof, it will be apparent to those skilled in the art that the disclosed invention may be modified in numerous ways and may assume many embodiments other than those specifically set out and described above. Accordingly, the appended claims are intended to cover all modifications of the present invention that fall within the true spirit and scope of the present invention.

What is claimed is:

1. An image forming apparatus comprising:

a photoreceptor; and a supplying member arranged to supply the photoreceptor with developer, the supplying member including:

a magnetic roller having a fixing member on an axial portion thereof; and a developing sleeve arranged on an outer circumference of the magnetic roller; wherein the supplying member is removably attached to a side of the photoreceptor by the fixing member to fix a pole position of the magnetic roller relative to the photoreceptor.

2. The image forming apparatus according to claim 1, wherein the fixing member includes a protruding portion; and the supplying member is attached to the side of the photoreceptor by inserting the protruding portion into a concave portion defined on the side of the photoreceptor.

3. The image forming apparatus according to claim 2, wherein the fixing member includes a cylindrical fixing member body and the protruding portion is arranged to protrude from an outer circumferential surface of the fixing member body.

4. The image forming apparatus according to claim 3, wherein a D-shaped through-hole is defined at an approximate center of a cross-section of the fixing member body; and a shaft is fixed to the magnetic roller and has a D-shaped section at an edge portion in an axial direction of the shaft.

5. The image forming apparatus according to claim 4, wherein a diameter of the fixing member body is greater than a diameter of the developing sleeve.

6. The image forming apparatus according to claim 5, wherein a protruding length of the protruding portion is greater than a concave length of the concave portion.

7. The image forming apparatus according to claim 6, wherein a gap pulley is fixed to the shaft.

8. The image forming apparatus according to claim 7, wherein the protruding portion is a pin or a rib.

9. The image forming apparatus according to claim 8, wherein the concave portion is a chase.

* * * * *